US005186612A

United States Patent [19]

Budzich, deceased

[11] Patent Number: 5,186,612

[45] Date of Patent: Feb. 16, 1993

[54] VARIABLE PRESSURE INLET SYSTEM FOR HYDRAULIC PUMPS

[75] Inventor: Tadeusz Budzich, deceased, late of Moreland Hills, Ohio, by Euphemia Agnes Marshal Budzich, executrix

[73] Assignee: Caterpillar Inc., Peoria, Ill.

[21] Appl. No.: 821,379

[22] Filed: Jan. 16, 1992

[51] Int. Cl.[5] ..... F04B 23/06

[52] U.S. Cl. ..... 417/216; 417/252; 417/287; 60/468

[58] Field of Search ..... 417/216, 218, 251, 252, 417/253, 286, 287, 288, 428; 60/452, 468

[56] References Cited

U.S. PATENT DOCUMENTS

| | | | |
|---|---|---|---|
| 1,972,560 | 9/1934 | Heller | 417/253 |
| 2,522,890 | 9/1950 | Peterson | 417/252 |
| 3,912,419 | 10/1975 | Lutz et al. | 417/252 |
| 4,014,628 | 3/1977 | Ruseff et al. | 417/203 |
| 4,199,944 | 4/1980 | Budzich | 60/452 |
| 4,907,949 | 3/1990 | Jourde | 417/252 |

FOREIGN PATENT DOCUMENTS 667684 6/1979 U.S.S.R. .

*Primary Examiner*—Leonard E. Smith
*Attorney, Agent, or Firm*—J. W. Burrows

[57] ABSTRACT

In the present fluid system, a variable pressure inlet system is provided and operational to control the operating pressure level of a charge pump in response to various operating parameters of the fluid system. The charge pump provides pressurized fluid to an inlet of a hydraulic pump to insure filling of the pumping chambers therein. By having the operating pressure level of a variable pressure relief valve that is connected to the charge pump controlled between a minimum pressure level and a maximum pressure level responsive to various operating perimeters of the system, the degree of horsepower needed to drive the charge pump is controlled. The operating pressure level of the variable pressure relief valve may be controlled in response to movement of a swash plate of the hydraulic pump, the speed of the input drive mechanism to the hydraulic pump, the movement of the spool of the control valve, or by the operating pressure level representative of a load L or by any combinations thereof acting in parallel one with the other.

9 Claims, 5 Drawing Sheets

VARIABLE PRESSURE INLET SYSTEM FOR HYDRAULIC PUMPS

TECHNICAL FIELD

This invention relates generally to providing pressurized fluid to the inlet of a hydraulic pump and more specifically to a control system for controlling the level of the pressure being subjected to the inlet of the hydraulic pump.

BACKGROUND ART

Hydraulic pumps have been commonly employed to deliver fluid under pressure to operate implement systems. It is well known to employ an additional charge pump, such as a centrifugal pump, for delivering input fluid to the hydraulic pump in order to insure "positive filling" of the pumping chambers within the hydraulic pump. One such example of a centrifugal pump used for providing "positive filling" of the hydraulic pump is set forth in U.S. Pat. No. 4,014,628 which issued on Mar. 29, 1977, to W.Z. Ruseff et al. In this arrangement, a centrifugal pump provides pressurized fluid to the inlet of the hydraulic piston pump. The centrifugal pump operates under a pressure as primarily dictated by the speed of the input drive mechanism connected to the hydraulic pump. Furthermore, as is well known, centrifugal pumps are not positive displacement pumps and may not operate at a desired controlled pressure level.

If a positive displacement charge pump is used to provide pressured fluid to the inlet of the hydraulic pump, a relief valve must be utilized to control the maximum pressure level of the fluid being delivered to the inlet of the hydraulic pump. Naturally, whenever flow is being delivered at a given pressure level, the system's power source must generate additional horsepower to drive the charge pump which provides the pressurized fluid flow to the inlet of the hydraulic pump. As main system hydraulic pumps become bigger in size, greater volume of fluid is needed to insure adequate filling of the main system hydraulic pumps. As the flow rate being generated by the charge pump increases and a constant pressure level is being utilized, additional horsepower is required to drive the charge pump. If the pressure level of the fluid flow from the charge pump is controlled, this additional horsepower could be utilized for other aspects of the system.

It is desirable to provide adequate fluid flow to the inlet of the main hydraulic pump to insure filling of the pumping chambers therein while providing only the pressure level to the fluid that is needed to properly fill the pumping chambers without consuming unnecessary horsepower when the main hydraulic pump is being operated at lower flow levels.

DISCLOSURE OF THE INVENTION

In one aspect of the present invention, a variable pressure inlet system is provided and adapted for use in a hydraulic pump having an inlet fill port. A charge pump is provided and connected to the inlet fill port and is operative to provide pressurized fluid to the inlet fill port of the hydraulic pump. The variable pressure inlet system includes a variable pressure relief valve and a control means. The variable pressure relief valve is connected to the charge pump and the control means varies the pressure level of the fluid being delivered from the charge pump.

BEST MODE FOR CARRYING OUT THE INVENTION

Figure 1:
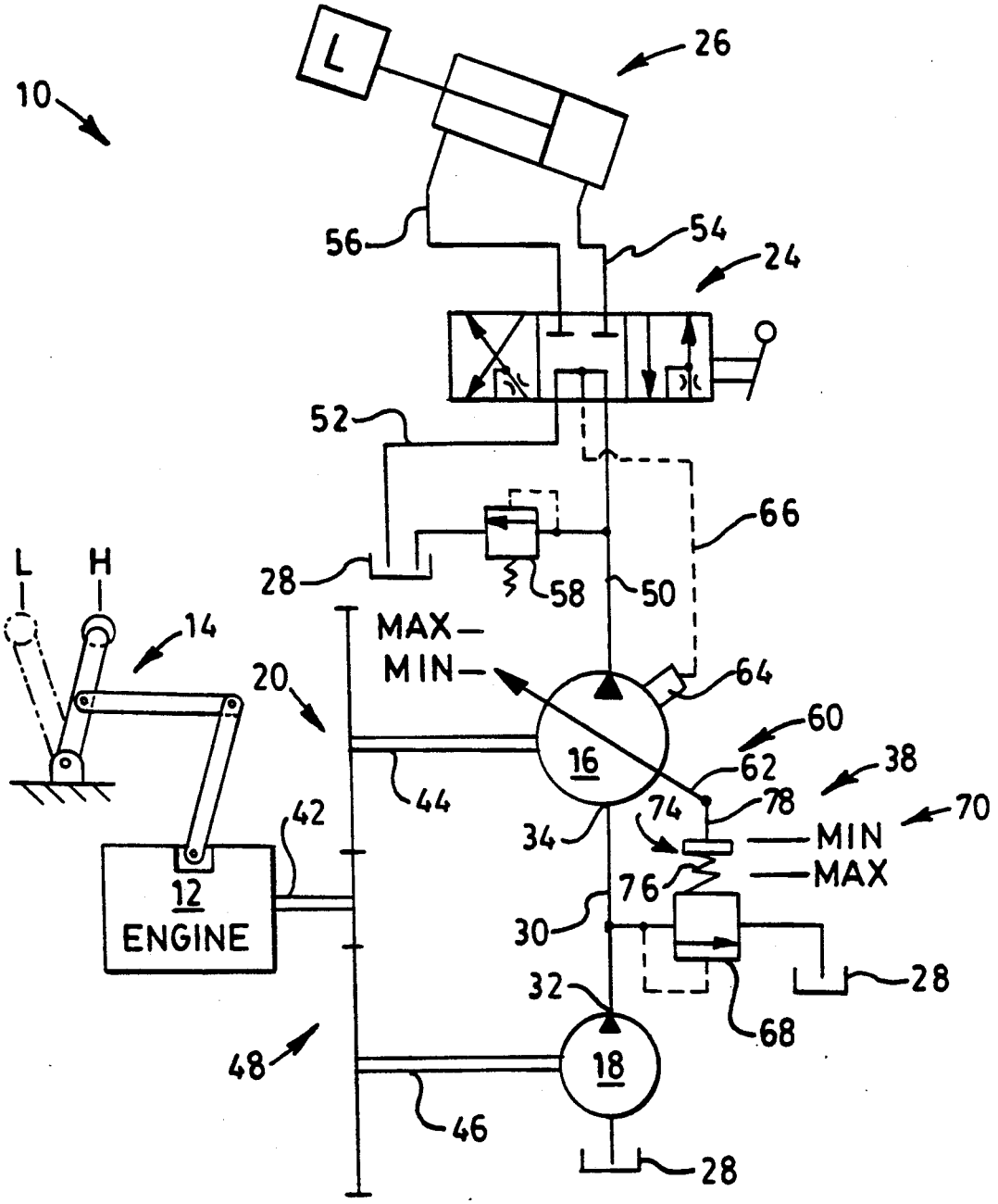
FIG. 1 is a partial schematic and a partial diagrammatic representation of an embodiment of the present invention.

Referring now to the drawings, and more particularly to FIG. 1, a fluid system 10 is illustrated. The fluid system 10 includes an engine 12 having a throttle control mechanism 14 operative to control the speed of the engine 12 between a low idle speed L and a high idle speed H. A hydraulic pump 16 and a charge pump 18 is connected to the engine 12 through an input drive mechanism 20. The fluid system 10 also includes a directional control valve 24 connected between a fluid motor 26 and the pump 16. The charge pump 18 receive fluid from a reservoir 28 in a conventional manner. A conduit 30 interconnects an outlet 32 of the charge pump 18 with an inlet port 34 of the hydraulic pump 16. A variable pressure inlet system 38 is fluidly connected to the charge pump 18 to control the pressure level of the fluid being discharged from the charge pump 18.

The input drive mechanism 20 includes an output shaft 42 connected to the output of the engine 12 and is operatively connected to drive an input shaft 44 of the hydraulic pump 16 and an input shaft 46 of the charge pump 18 through a gear drive assembly 48.

A conduit 50 connects the hydraulic pump 16 to the directional control valve 24 while conduit 52 connects the exhaust flow from the directional control valve 24 to the reservoir 28. The fluid motor 26 is connected to the directional control valve 24 by conduits 54, 56. A conventional relief valve 58 is connected to the conduit 50 and is operative to control the maximum pressure level of the fluid in the conduit 50.

The hydraulic pump 16 of the subject embodiment is a variable flow capacity pump and has flow capacity adjustment means 60 in the form of a swash plate 62 which is diagrammatically illustrated. The swash plate 62 is operative to control the flow of the hydraulic pump 16 between a minimum displacement level (MIN) and a maximum displacement level (MAX). In many instances the minimum flow displacement is zero flow displacement. However, it is recognized that the minimum flow level could be something other than zero flow.

The flow capacity adjustment means 60 also includes a flow pressure compensator 64 which receives a signal representative of the load through a signal conduit 66 which is connected, in a conventional manner, between the flow pressure compensator 64 of the hydraulic pump 16 and the directional control valve 24.

The directional control valve 24 is operable, in a conventional manner, from a neutral position at which the outlet from the fluid pump 16 is in open communication with the reservoir 28 to a first position at which fluid flow is directed to the fluid motor 26 to move the fluid motor in one direction and movable to a second position at which fluid flow from the hydraulic pump 16 is directed to the fluid motor 26 to move it in the opposite direction.

The variable pressure inlet system 38 includes a variable pressure relief valve 68 and a control means 70. The variable pressure relief valve 68 is operable to control the pressure level of the fluid from the charge pump 18 between a minimum pressure level (MIN) and a maximum pressure level (MAX).

The control means 70 of the subject embodiment includes a biasing means 74 having a spring 76 connected to the variable pressure relief valve 68 and operative to control the variable pressure relief valve 68 between its minimum pressure level (MIN) and its maximum pressure level (MAX).

A mechanical connection 78 is operatively connected between the biasing means 74 and the swash plate 62 of the hydraulic pump 16. The mechanical connection 78 is operative to increase the force of the biasing means 74 thus increasing the operating pressure setting of the variable pressure relief valve 68 from its minimum pressure level (MIN) towards its maximum pressure level (MAX) in response to the swash plate 62 moving from its minimum flow displacement (MIN) towards its maximum flow displacement (MAX).

Figure 2:
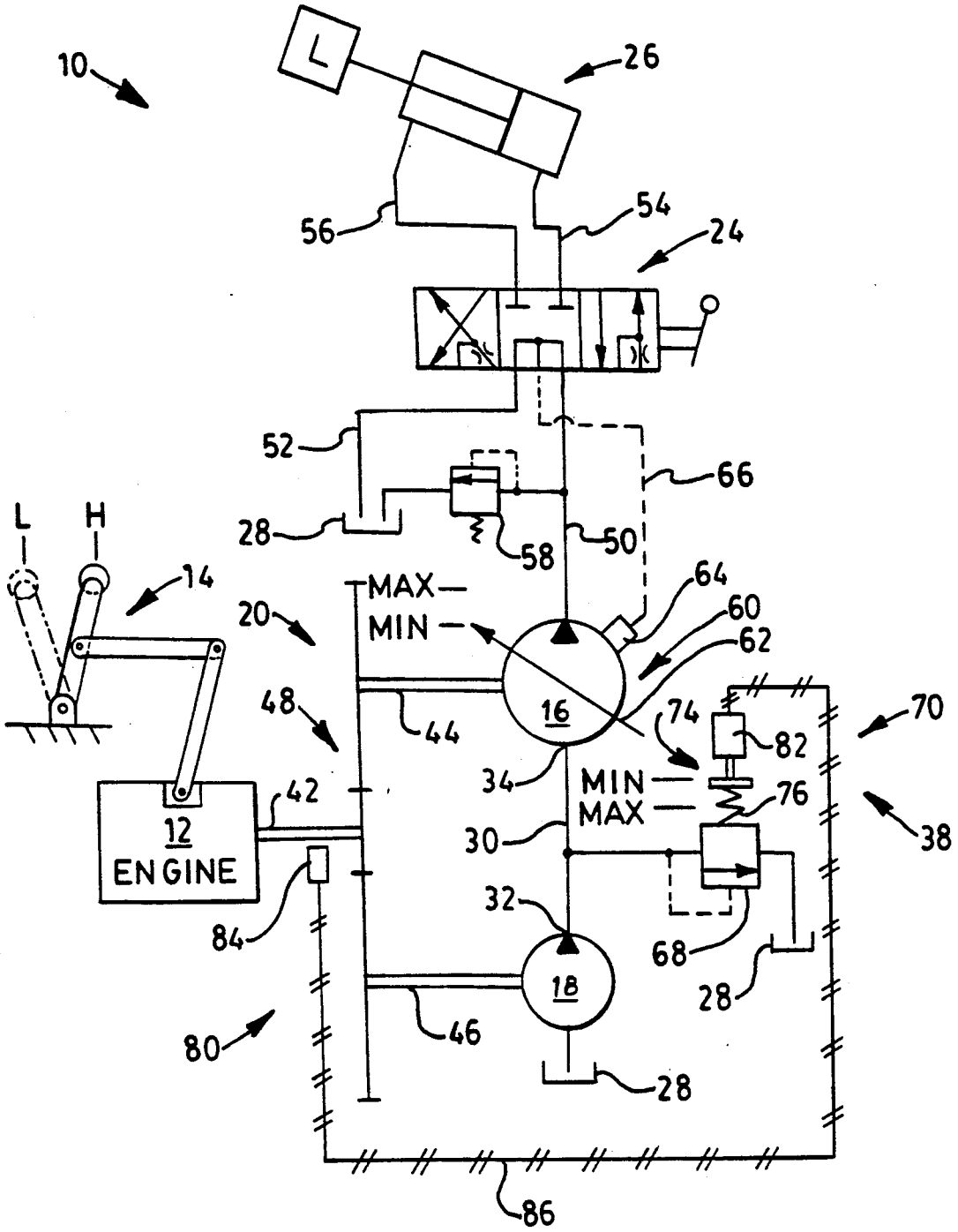
FIG. 2 is a partial schematic and a partial diagrammatic representation of another embodiment of the present invention.

Referring now to FIG. 2 of the drawings, another embodiment of the fluid system 10 is illustrated. The fluid system 10 of the subject embodiment is quite similar to the fluid system 10 of the embodiment illustrated in FIG. 1. Consequently, like elements will have corresponding element numbers. Only the differences between the embodiment of FIG. 2 and that of FIG. 1 will be described.

The mechanical connection 78 between the swash plate 62 of the pump 16 and the biasing means 74 illustrated and described with respect to FIG. 1 is not present in FIG. 2. The control means 70 of FIG. 2 includes speed sensor means 80 that is operative to sense the output speed of the engine 12 which is representative of the input speed of the hydraulic pump 16 and to generate an electrical signal proportional thereto.

The biasing means 74 includes the spring 76 and an electrically controlled actuator 82. The speed sensing means 80 includes a speed sensor 84 which senses the speed of the output shaft 42 of the engine 12. Since the output shaft 42 of the engine 12 is drivingly connected to the input shaft 44 of the pump 16, the speed of the output shaft 42 of the engine 12 is directly proportional to the speed of the input shaft 44 of the pump 16. The speed sensor 84 generates an electrical signal proportional to the speed of the shaft 42 and directs the electrical signal through an electrical line 86 to the electrically controlled actuator 82. The electrically controlled actuator 82 provides an output force to the spring 76 that is proportional to the electrical signal received through the electrical line 86. Consequently, the operating pressure setting of the variable pressure relief valve 68 is varied accordingly.

Figure 3:
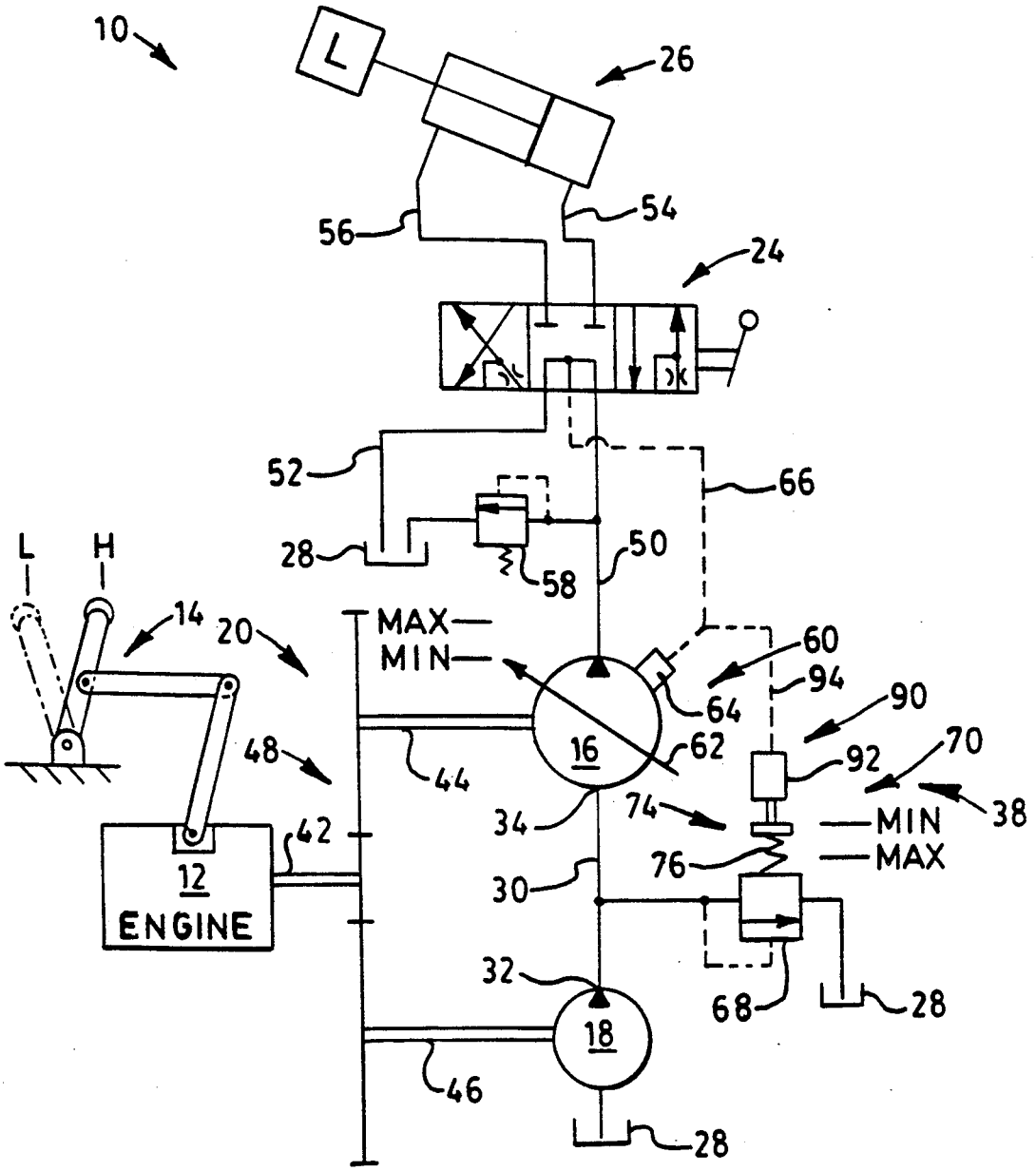
FIG. 3 is a partial schematic and a partial diagrammatic representation of another embodiment of the present invention.

Referring to FIG. 3 of the drawings, another embodiment of the fluid system 10 is illustrated. The fluid system 10 of the subject embodiment is quite similar to the fluid system 10 of the embodiment illustrated is FIG. 1. Consequently, like elements will have corresponding element numbers. Only the differences between the embodiment of FIG. 3 and that of FIG. 1 will be described.

The mechanical connection 78 between the swash plate 62 of the pump 16 and the biasing means 74 illustrated and described with respect to FIG. 1 is not present in FIG. 3. The control means 70 of FIG. 3 includes load signal sensing means 90 that is operative to receive a signal representative of the load L and to transmit a hydraulic signal proportional there to.

The biasing means 74 includes the spring 76 and a hydraulically controlled actuator 92. A conduit 94 is connected between the signal conduit 66 and the hydraulically controlled actuator 92. The hydraulic load signal present in conduit 66 is representative of the magnitude of the load L and is transmitted thru the conduit 94 to the hydraulically controlled actuator 92. The hydraulically controlled actuator 92 provides an output force to the spring 76 that is proportional to the load signal received through the conduit 94. Consequently, the operating pressure setting of the variable pressure relief valve 68 is varied accordingly.

Figure 4:
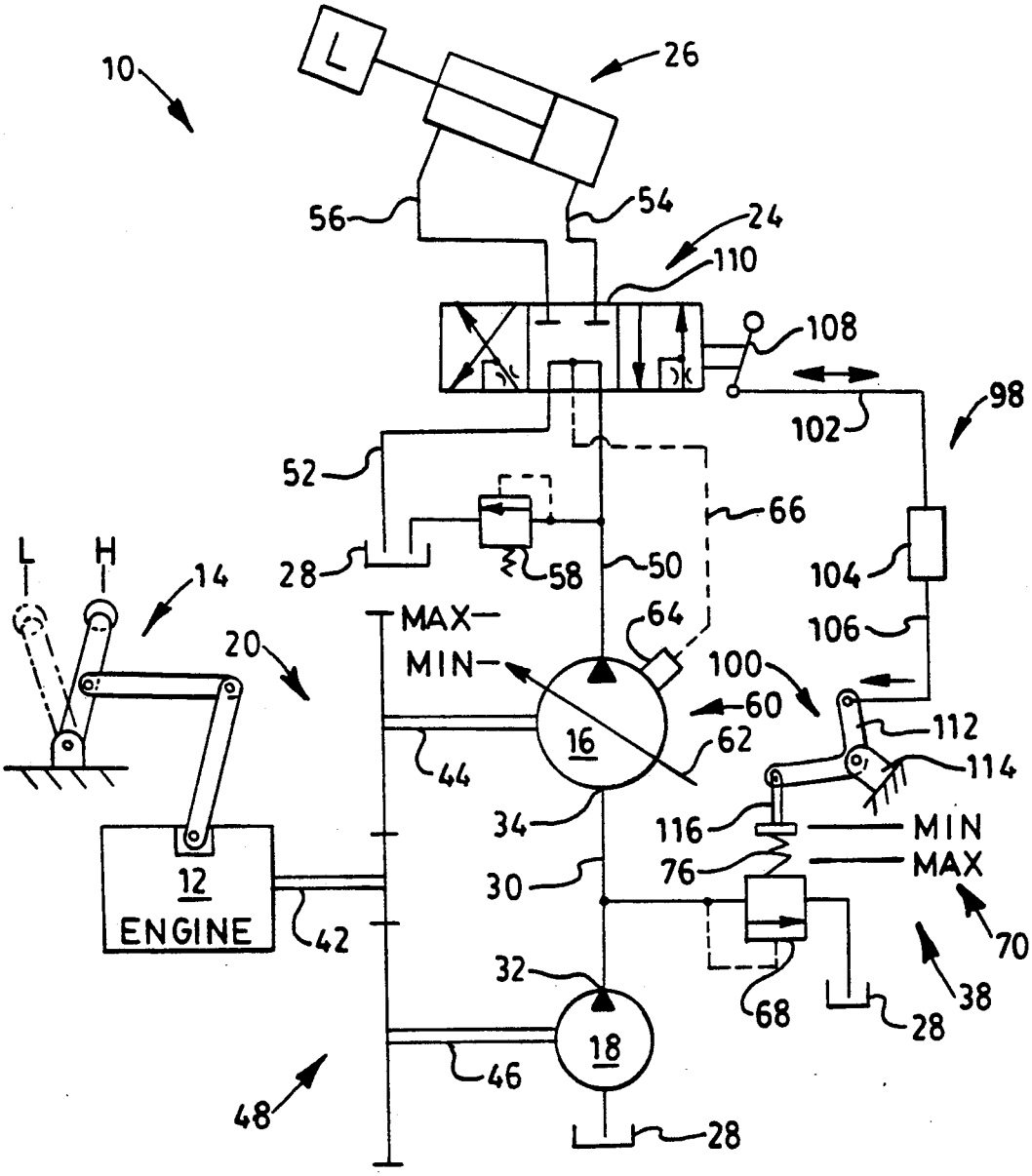
FIG. 4 is a partial schematic and a partial diagrammatic representation of another embodiment of the present invention.

Referring now to FIG. 4 of the drawings, another embodiment of the fluid system 10 is illustrated. The fluid system 10 of the subject embodiment is quite similar to the fluid system 10 of the embodiment illustrated in FIG. 1. Consequently, like elements will have corresponding element numbers. Only the differences between the embodiment of FIG. 4 and that of FIG. 1 will be described.

The mechanical connection 78 between the swash plate 62 of the pump 16 and the biasing means 74 illustrated and described with respect to FIG. 1 is not present in FIG. 4. The control means 70 of FIG. 4 includes spool displacement sensing means 98 for sensing the movement of the directional control valve 24 between its neutral and first or second operating positions and for transmitting a proportional signal representative of the sensed movement.

The biasing means 74 includes the spring 76 and a force transmitting means 100. The spool displacement sensing means 98 includes a mechanical link 102, a motion translator mechanism 104, a mechanical link 106, and the force transmitting means 100. A control lever 108 is operative to move a diagrammatically illustrated spool 110 between the neutral position and the first and second operating positions. The mechanical link 102 is connected to the input lever 108 of the control valve 24 and is operative to transmit the movement thereof to the force transmitting means 100 which in turn loads the spring 76 so that the spring 76 is loaded proportional to any movement of the lever 108 from its neutral position towards its first or second operating positions. The motion translator mechanism 104 is operative to receive the input from the mechanical link 102 in either direction of movement of the control lever 108 and to provide movement of the mechanical link 106 in only one direction therefrom that is proportional to the input movement from the mechanical link 102.

The force transmitting means 100, in the subject embodiment, includes a bellcrank 112 pivotally connected to an anchor 114 and a force transmitting rod 116 that is connected to the spring 76. The force transmitting means 100 provides an output force to the spring 76 that is proportional to the sensed movement of the spool 110 of the control valve 24 as transmitted through the spool displacement sensing means 98. Consequently, the operating pressure setting of the variable pressure relief 68 is varied accordingly.

Figure 5:
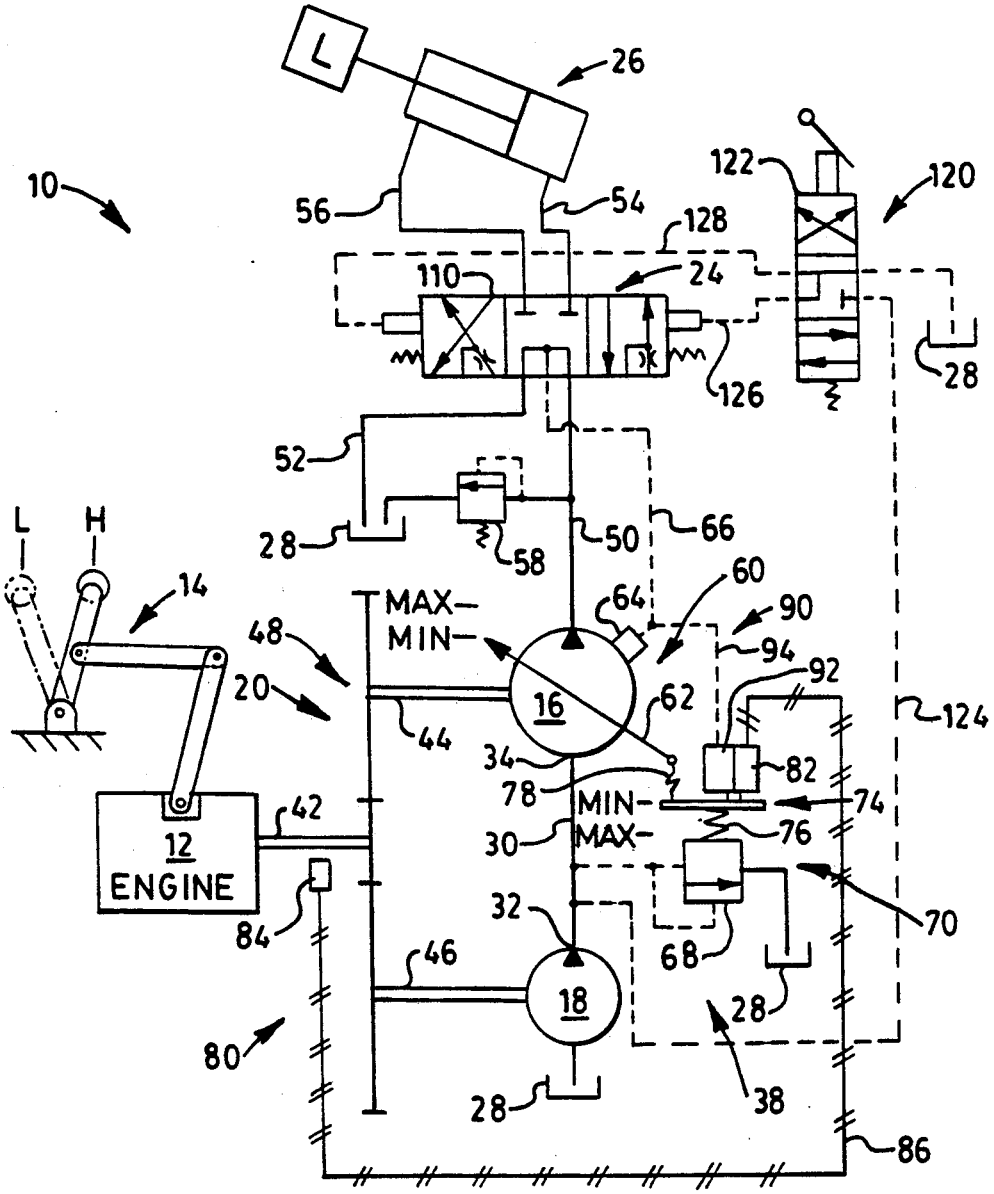
FIG. 5 is a partial schematic and a partial diagrammatic of another embodiment of the present invention.

Referring now to FIG. 5 of the drawings, another embodiment of the fluid system 10 is illustrated. The fluid system 10 of the subject embodiment is quite similar to the fluid system 10 of the embodiments illustrated in FIGS. 1-3. Consequently, like elements will have corresponding like element numbers. Only the differences between the embodiment of FIG. 5 and that of FIGS. 1-3 will be described. In the embodiments of FIGS. 1-3, the schematically illustrated directional control valve 24 is a manually operated directional control valve. In the embodiment of FIG. 5, a pilot operated control valve 24 is illustrated. The control valve 24 of FIG. 5 is controlled in a conventional manner by a pilot system 120. The pilot system 120 includes a pilot valve 122 which receives pressurized fluid from the charge pump 18 through a conduit 124. The pilot control valve 122 is connected to opposite ends of the pilot control valve 24 through conduits 126, 128. In a conventional manner, movement of the pilot control valve 122 between its first and second operating positions directs pressurized fluid to the respective ends of the pilot operated control valve 24 to move the spool 110 therein between its first and second operative positions.

The mechanical connection 78 between the swash plate 62 of the pump 16 and the biasing means 74 illustrated and described with respect to FIG. 1 is also present herein. However in the subject embodiment, the control means 70 also includes the speed sensing means 80 and its electrically controlled actuator 82 and the load signal sensing means 90 along with its hydraulically controlled actuator 92. Each of the mechanical connection 78, the output force of the electrically controlled actuator 82, and the output force of the hydraulically controlled actuator 92 act in parallel to load the spring 76 thus increasing the operating pressure level of the variable pressure relief valve 68. It should be recognized that either the mechanical connection 78, the output force of the electrically controlled actuator 82 or the output force of the hydraulically controlled actuator 92 can individually and separately load the spring 76. Consequently, the operating pressure setting of the variable pressure relief valve 68 is varied in response to either movement of the swash plate 62, a change in speed of the input drive mechanism 20, or a change in the magnitude of the load L.

Even though, in FIG. 5, the mechanical connection 78, the electrically controlled actuator 82, and the hydraulically controlled actuator 92 are each shown acting in parallel to proportionally load the spring 76, it is recognized that any two of the members may act in parallel to load the spring 76 as opposed to requiring all three in the system. Furthermore, the spool displacement sensing means 98, as illustrated in FIG. 4, could operate in parallel with either of the mechanical connection 78, the electrically controlled actuator 82, and the hydraulically controlled actuator 92 with out departing from the essence of the invention. In addition, even though the spool displacement sensing means 98, as illustrated in FIG. 4, is a mechanical connection, it is recognized that the displacement of the spool 110 and or the control level 108 could be sensed by other means, such as electrical sensors, with out departing from the essence of the invention.

INDUSTRIAL APPLICABILITY

In the operation of the embodiment illustrated in FIG. 1 with the engine 12 operating in the high idle H condition as illustrated, the input drive mechanism 20 rotates the hydraulic pump 16 and the charge pump 18 at their respective maximum speed levels. Since the charge pump 18 is a positive displacement pump, the pressurized fluid flow at the outlet 32 thereof is controlled relative to the pressure setting of the variable pressure relief valve 68.

The hydraulic pump 16, as illustrated, is a variable flow pump and its displacement thereof is controlled between its minimum displacement position (MIN) and its maximum displacement position (MAX) by the swash plate 62. In the subject embodiment, the swash plate 62 is illustrated at its minimum flow displacement position which is zero displacement. However, it is recognized that the swash plate 62 could be at some other position that is low flow but not necessarily zero flow.

The position of the swash plate 62 of the variable pump 16 is controlled by the load signal which is representative of the load L and transmitted to the pressure compensator 64 from the directional control valve 24 through the signal conduit 66. Since the control valve 24 is in its neutral position, there is no load signal being transmitted through the signal conduit 66 to the pressure compensator 64. Consequently, the variable pump 16 remains at its minimum displacement (MIN). Once the control valve 24 is moved to one of its operating positions, a hydraulic signal representative of the load L is transmitted through the signal conduit 66 to the pressure compensator 64 causing the swash plate 62 to move towards its maximum displacement position (MAX) in order to satisfy the flow and pressure requirements of the load as established by the degree of movement of the directional control valve 24.

In the subject arrangement, movement of the swash plate 62 from its minimum displacement position (MIN) towards its maximum displacement position (MAX) increases the force on the spring 76. The loading of the spring 76 is a result of the swash plate 62 being moved from its minimum displacement position towards its maximum displacement position. The degree of loading of the spring 76 between its minimum loaded condition (MIN) and its maximum loaded condition (MAX) is proportional to the movement of the swash plate 62 between its minimum displacement position and its maximum displacement position.

In at least one example, in order to conserve the horsepower being generated by the engine 12, the variable pressure relief valve 68 has a minimum pressure setting in the order of 103 kPa (15 psi) at zero swash plate angle to, for example, 690 kPa (100 psi) at maximum swash plate angle. Since the horsepower required to drive the charge pump 18 is directly proportional to the fluid flow therefrom times the pressure of the flow, the amount of horsepower needed for the charge pump when being operated at the lower pressure level is significantly lower. Likewise, when the hydraulic pump 16 is being operated at zero flow displacement or near zero flow displacement, the volume of pressurized fluid flow needed to fill the pumping chambers of the hydraulic pump 16 is low. As the hydraulic pump 16 is being moved towards its maximum flow displacement position, the requirement of inlet flow to the inlet 34 thereof is increased. Consequently, it is necessary to increase the pressure level of the fluid flow from the charge pump 18 in order to meet the needed fill requirements of the pumping chambers within the hydraulic pump 16. This is accomplished by the force on the spring 76 being increased as a result of the swash plate 62 being moved from its minimum displacement position (MIN) towards its maximum displacement position (MAX).

Once the control valve 24 is returned to its neutral position, the signal representative of the load L being transmitted through the signal conduit 66 is interrupted and the swash plate 62 returns to its minimum displacement position. Consequently, the force on the spring 76 is reduced to its minimum setting and the variable pressure relief valve 68 is returned to its minimum displacement position. At the minimum displacement position of the variable pressure relief valve 68, the pressure level of the fluid flow from the charge pump 18 is significantly reduced thus reducing the horsepower requirement needed from the engine 12. By reducing the horsepower requirement needed by the variable pressure inlet system 10, the saved horsepower may be utilized elsewhere in the system or may reduce the load on the engine 12 consequently conserving energy requirements of the engine 12.

The operation of the fluid system 10 of FIG. 2 is quite similar to that set forth with respect to FIG. 1 except in FIG. 2, the mechanical connection 78 between the swash plate 62 and the biasing means 74 is not present. In the embodiment of FIG. 2, the speed sensor means 80 is provided to sense the speed of the output shaft 42 of the engine 12 which is directly related to the speed of the input shafts 44, 46 to the respective hydraulic pump 16 and the charge pump 18. The sensed speed of the input drive mechanism 20 to the hydraulic pump 16 is transmitted to the electrically controlled actuator 82 which loads the spring 76 proportional to the speed of the input drive mechanism 20. Consequently, with the engine 12 operating at the low idle condition L, the force on the spring 76 is at its minimum level and as the speed of the engine 12 is increased towards its high idle position H, the force on the spring 76 is proportionally increased towards its maximum position proportional to the increase in the speed of the engine 12. Therefore, when the engine 12 is being operated at its low idle condition, the horsepower requirement needed to operate the variable pressure inlet system 38 is lower since the operating pressure setting of the variable pressure relief valve 68 is at the minimum pressure level.

Even though the hydraulic pump 16 of the subject embodiment is shown as a variable displacement pump, it is recognized, that the hydraulic pump 16 could be of a fixed displacement type without departing from the essence of the invention. Other aspects of the operation of the embodiment of FIG. 2 is substantially the same as that set forth with respect to FIG. 1.

The operation of the fluid system 10 of FIG. 3 is quite similar in nature to the operation of the embodiment set forth in FIG. 1 with the exception that the mechanical connection 78 between the swash plate 62 and the biasing means 74 is not present. In the subject arrangement of FIG. 3, the hydraulically controlled actuator 92 loads the spring 76 of the biasing means 74 in response to increases in the load pressure as directed thereto through the conduit 94 from the conduit 66. Consequently, the spring 76 is loaded in proportion to the increase in the load pressure as dictated by the load L and increases the operating pressure setting of the variable pressure relief valve 68 proportional thereto.

When the hydraulic pump 16 is not receiving the load signal, the operating pressure level of the variable pressure relief valve 68 is at its minimum position. As the hydraulic pump 16 receives a load signal through the conduit 66 the spring 76 of the biasing means 74 is loaded to increase the operating pressure setting of the variable pressure relief valve 68 from its minimum position towards its maximum position. Likewise as the load pressure signal decreases or is removed, the operating pressure setting of the variable pressure relief valve 68 is lowered or returned to its minimum operating pressure level. When the load pressure is not being imposed on the pressure compensator 64 of the hydraulic pump 16, the degree of horsepower needed to operate the charge pump 18 is minimized The operation of the embodiment illustrated in FIG. 4 is quite similar to that illustrated in FIG. 1 with the exception that the mechanical connection 78 is not present. In the embodiment illustrated in FIG. 4, the spool displacement sensing means 98 senses the degree of movement of the spool 110 of the directional control valve 24 and transmits the sensed movement to the forced transmitting means 100. The force transmitting means 100 loads the spring 76 so that the operating pressure setting of the variable pressure relief valve 68 is varied from its minimum operating pressure level towards its maximum operating pressure level in response to the degree of movement of the spool 110 of the directional control valve 24.

Even though the fluid system 10 of the subject embodiment illustrates the hydraulic pump 16 as being of the variable flow capacity, it should be recognized that the hydraulic pump 16 could be a fixed displacement pump with out departing from the essence of the invention. As set forth with the previous embodiments, when the directional control valve 24 is in its neutral position, the variable pressure inlet system 38 is maintained at its minimum pressure operating condition. As the directional control valve 24 is moved from its neutral position towards its maximum flow position, the operating pressure setting of the variable pressure relief valve 68 is increased from its minimum operating pressure level to its maximum operating pressure level. This increase in operating pressure level is proportional to the degree of movement of the directional control valve 24 between its neutral position and its full operating condition.

The operation of the embodiment illustrated in FIG. 5 is similar to the operation of the embodiments set forth in FIGS. 1–3. However, in the embodiment illustrated in FIG. 5, the directional control valve 24 is a pilot operated directional control valve and the displacement thereof is controlled by a pilot system 120 in a conventional matter. The pilot valve 122 of the pilot system 120 receives its pressurized fluid from the charged pump 18 through the conduit 124.

The mechanical connection 78 as illustrated in FIG. 1 is likewise illustrated in FIG. 5. However, in the embodiment of FIG. 5, the electrically controlled actuator 82 and the hydraulically controlled actuator 92 each act in parallel with the mechanical connection 78 to load the spring 76 for varying the operating pressure setting of the variable pressure relief valve 68 from its minimum operating pressure level towards its maximum operating pressure level. In the embodiment of FIG. 5, the spring 76 is loaded in response to either an increase in the engine 12 RPM, an increase in the load pressure signal being received through conduit 94, or by the movement of the swash plate 62 from its minimum displacement position towards its maximum displacement position. Even though the spring 76 is being subjected to a load from three different operating conditions, the force on the spring 76 can only be increased from its minimum operating pressure setting to its maximum operating pressure setting.

Even though the embodiment of FIG. 5 is illustrated as being a pilot operated system, it is recognized that this system could readily be used with a manually controlled control valve 24 without departing from the essence of the invention. Further more, the spool displacement sensing means 98 as illustrated in FIG. 4 could be utilized with the pilot system 120 of FIG. 5 by having the mechanical link 102 operatively connected to the input lever of the pilot valve 122.

In view of the foregoing, it is readily apparent that the fluid system 10 of the present invention provides a variable pressure inlet system 38 that controls the operating pressure level of the charge pump 18 proportional to various operating parameters of the fluid system 10 to effectively conserve the horsepower requirements of the engine 12 while still providing adequate fluid flow to fill the pumping chambers of the hydraulic pump 16.

Other aspects, objects, and advantages of this invention can be obtained from a study of the drawings, the disclosure, and the appended claims.

It is claimed:

1. A variable pressure inlet system adapted for use in a system including a variable flow capacity hydraulic pump having a movable swash plate to control the rate of fluid flow therefrom between a minimum and a maximum position and an inlet fill port, a charge pump connected to the inlet fill port to provide pressurized fluid to the inlet fill port of the hydraulic pump, and a variable pressure relief valve including biasing means for varying the operating pressure setting thereof and being connected to the charge pump to control the operating pressure level of the fluid flow therefrom, the variable pressure inlet system comprising:

control means interconnected between the swash plate and the biasing means for varying the operating pressure setting of the variable pressure relief valve in response to the movement of the swash plate between its minimum and maximum flow positions.

2. The variable pressure inlet system of claim 1 including in combination a pilot operated control system connectable to the charge pump in parallel with the inlet fill port of the hydraulic pump.

3. The variable pressure inlet system of claim 1 wherein the control means includes a mechanical connection between the biasing means of the variable pressure relief valve and the swash plate of the hydraulic pump.

4. The variable pressure inlet system of claim 3 wherein the biasing means includes a spring.

5. The variable pressure inlet system of claim 4 wherein the biasing means includes an electrically controlled actuator and the control means includes speed sensor means adapted to sense the speed of the hydraulic pump and to transmit an electrical signal to the electrically controlled actuator that is proportional to the speed of the hydraulic pump, the force from the electrically controlled actuator and the mechanical connection operate in parallel on the spring of the biasing means to control the operating pressure setting of the variable pressure relief valve.

6. The variable pressure inlet system of claim 1 including an input drive mechanism connected to and driving the hydraulic pump and the control means includes speed sensor means for sensing the speed of the input drive mechanism and for transmitting an electrical signal to the biasing means that is proportional to the speed of the input drive mechanism.

7. The variable pressure inlet system of claim 6 wherein the biasing means includes a spring and an electrically controlled actuator operative to receive the electrical signal from the speed sensor means and to apply a force to the spring proportional to the electrical signal so that the operating pressure setting of the variable pressure relief valve is controlled proportional to the speed of the hydraulic pump.

8. The variable pressure inlet system of claim 7 wherein the biasing means includes a hydraulically controlled actuator and the control means includes load signal sensing means for sensing the load pressure and for transmitting the load pressure signal to the hydraulically controlled actuator so that the pressure setting of the variable pressure relief valve is varied in proportion to the pressure level of the load signal.

9. The variable pressure inlet system of claim 8 wherein the control means includes a mechanical connection between the flow capacity adjustment means of the hydraulic pump and the spring of the biasing means, the hydraulically controlled actuator, the electrically controlled actuator and the mechanical connection each act in parallel to load the spring to vary the operating pressure setting of the variable pressure relief valve between its minimum pressure level and its maximum pressure level.

* * * * *